US011134758B2

(12) United States Patent
Yun et al.

(10) Patent No.: US 11,134,758 B2
(45) Date of Patent: Oct. 5, 2021

(54) ORNAMENT ATTACHABLE AND DETACHABLE APPARATUS

(71) Applicant: Sema Global Co., Ltd., Seongnam-si (KR)

(72) Inventors: Dongque Yun, Seongnam-si (KR); Minque Yun, Seongnam-si (KR)

(73) Assignee: Sema Global Co., Ltd., Seongnam-si (KR)

( * ) Notice: Subject to any disclaimer, the term of this patent is extended or adjusted under 35 U.S.C. 154(b) by 0 days.

(21) Appl. No.: 16/503,643

(22) Filed: Jul. 5, 2019

(65) Prior Publication Data

US 2021/0000228 A1 Jan. 7, 2021

(51) Int. Cl.
*A44C 1/00* (2006.01)
*A44C 3/00* (2006.01)

(52) U.S. Cl.
CPC ..... *A44C 1/00* (2013.01); *A44C 3/00* (2013.01); *A44D 2203/00* (2013.01); *Y10T 24/13* (2015.01); *Y10T 24/32* (2015.01)

(58) Field of Classification Search
CPC ..... A44D 2203/00; A41F 1/002; Y10T 24/32; Y10T 24/13
See application file for complete search history.

(56) References Cited

U.S. PATENT DOCUMENTS

| | | | | | |
|---|---|---|---|---|---|
| 3,034,320 | A * | 5/1962 | Feibelman | A44C 7/00 | 63/14.1 |
| 5,974,634 | A * | 11/1999 | Eisenpresser | A44B 1/04 | 24/303 |
| 7,481,255 | B1 * | 1/2009 | Rees | A45C 13/023 | 150/106 |
| 2002/0170147 | A1 * | 11/2002 | Heller | A45F 5/02 | 24/3.3 |
| 2006/0005361 | A1 * | 1/2006 | O'Banion | A42B 1/24 | 24/303 |
| 2009/0050164 | A1 * | 2/2009 | Faccin | A61N 2/06 | 131/270 |
| 2012/0278974 | A1 * | 11/2012 | James | A41F 1/002 | 2/336 |
| 2013/0219667 | A1 * | 8/2013 | Walczak | A44B 99/00 | 24/3.1 |
| 2015/0208766 | A1 * | 7/2015 | Bielecki | A44B 17/0041 | 24/303 |
| 2018/0064193 | A1 * | 3/2018 | Curtis | A44C 1/00 | |

* cited by examiner

*Primary Examiner* — Robert Sandy
*Assistant Examiner* — Michael S Lee
(74) *Attorney, Agent, or Firm* — Revolution IP, PLLC

(57) ABSTRACT

A technical object of the present invention is to provide an ornament attachable and detachable apparatus which may attach and detach an ornament without piercing a product. To this end, the ornament attachable and detachable apparatus for attaching and detaching an ornament to and from a product according to the present invention includes: a first magnet positioned on an inner surface of the product; a second magnet of which a portion is positioned on an outer surface of the product to correspond to the first magnet and which has a different polarity from the first magnet; and a mounting portion mounting the ornament on another portion of the second magnet.

1 Claim, 3 Drawing Sheets

[FIG. 1]
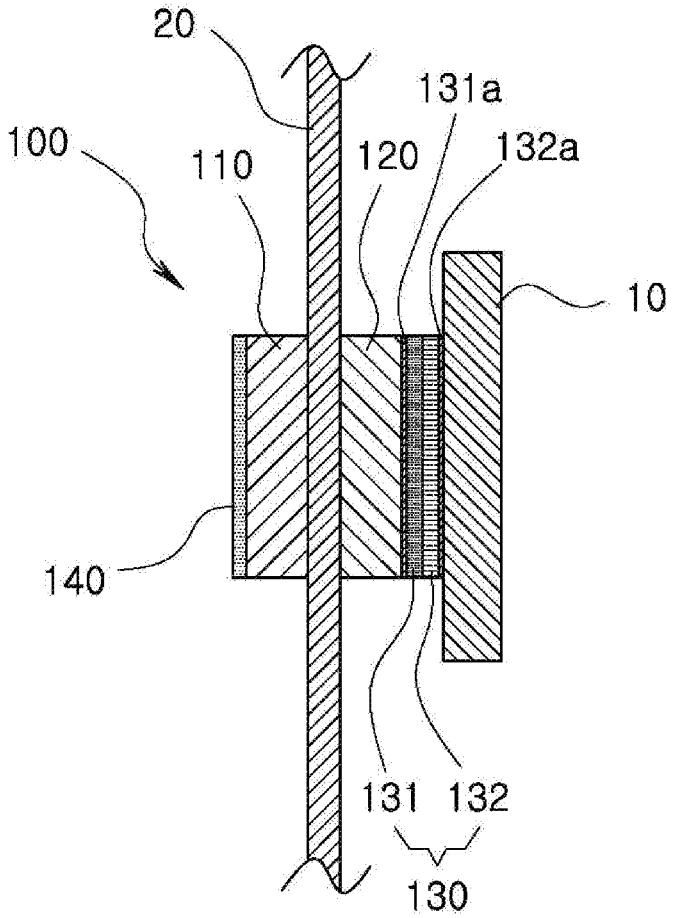

[FIG. 2]
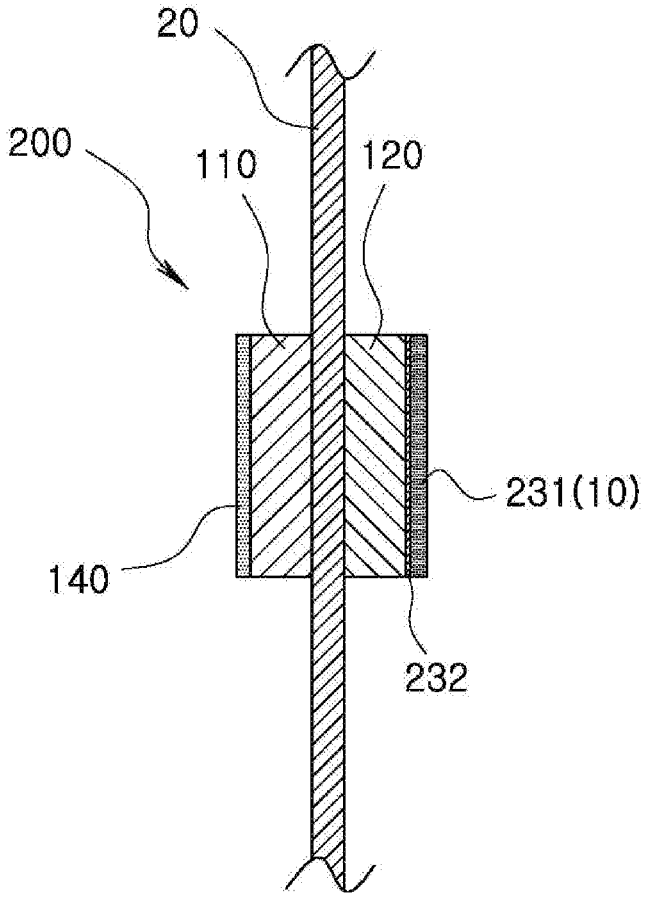

[FIG. 3]
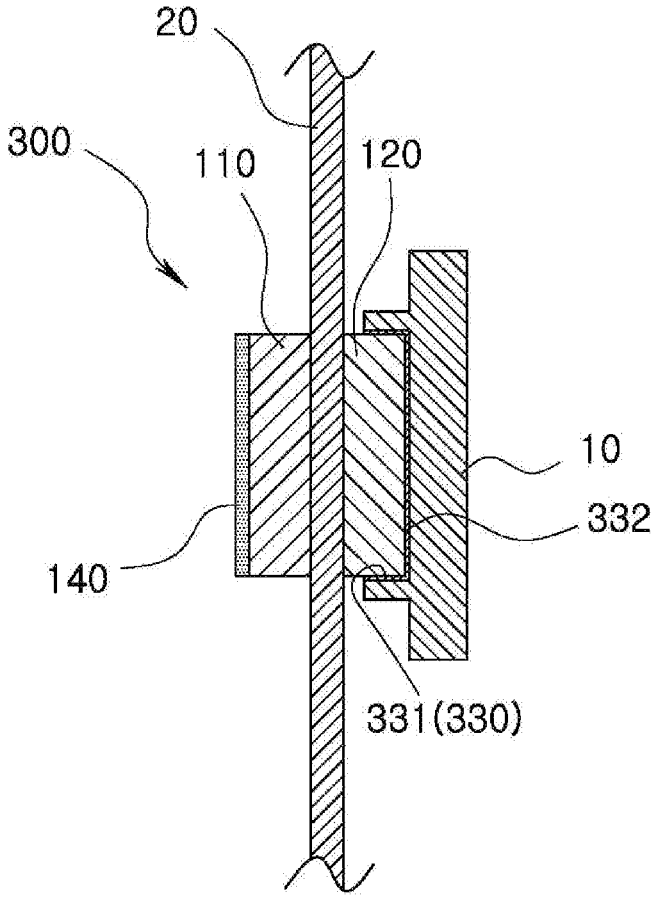

ORNAMENT ATTACHABLE AND DETACHABLE APPARATUS

TECHNICAL FIELD

The present invention relates to an ornament attachable and detachable apparatus.

BACKGROUND ART

In general, ornaments which are used for decorating products such as clothes, hats, shoes, bags, and the like are provided in various sizes and forms such as accessories such as brooches and covers such as outer shells.

Conventional ornamental attachable and detachable devices for detachably attaching ornaments having various sizes and forms to products are provided with technical constructions including fixing members such as clothes pins and adhesives for fixing them to the ornaments. Therefore, after the end of the clothes pin is detached from the catch of the clothes pin, the product is pierced by using a sharp end of the clothes pin to insert and remove the end of the clothes pin, and then the end of the clothes pin is hooked on a catch portion of the clothes pin again, thereby attaching the ornament to the product. In addition, an opposite process thereto may remove the ornament from the product. Ultimately, various kinds of ornaments can be attached to and detached from the product through the ornament attachable and detachable apparatus.

However, in the conventional ornament attachable and detachable apparatus, there is a problem that a hole mark is formed on the product by the end of the clothes pin. In addition, there is a risk that a user's hand is stabbed at the tip of the clothes pin when the clothes are detached or attached, and the tip of the clothes pin is likely to puncture the user's skin when the clothes pin is opened from the catch portion while the clothes pin is being pressed. In addition, when the product is made of a material that can not be pierced by a spin pin, or when the product is thin and easily torn like silk or rayon, there is a problem that a conventional ornament attachable and detachable apparatus can not be used.

DISCLOSURE

Technical Problem

A technical object of the present invention is to provide an ornament attachable and detachable apparatus which may attach and detach an ornament without piercing a product.

Another technical object of the present invention is to create personality and produce various displays with a unique Do It Yourself (DIY) fashion product in the world by means of my own fashion product and reduce resource recycling waste by variously changing one product and using the product for a long time by providing an ornament attachable and detachable apparatus which may safely and rapidly decorate a product of a user with an ornament so as to respond to a fast fashion age in which a fashion is rapidly changed and a new fashion is continuously pursued.

Technical Solution

In order to achieve the object, an ornament attachable and detachable apparatus for attaching and detaching an ornament to and from a product according to an embodiment of the present invention includes: a first magnet positioned on an inner surface of the product; a second magnet of which a portion is positioned on an outer surface of the product to correspond to the first magnet and which has a different polarity from the first magnet; and a mounting portion mounting the ornament on another portion of the second magnet.

As an example, the mounting portion may include a first Velcro provided at another portion of the second magnet, and a second Velcro provided in the ornament and attached to and detached from the first Velcro.

As another example, the ornament may be a loop Velcro and the mounting portion may be a double-sided tape that bonds the loop Velcro to another portion of the second magnet.

As yet another example, the mounting portion may be a mounting groove which is recessed in the ornament and accommodates and mounts another portion of the second magnet.

The product may be any one of clothes, hats, shoes, and bags.

The material of the product may include leather or silk materials.

Each of the first and second magnets may be a neodymium magnet.

A surface of the first magnet facing a human body may be coated with a skin allergy reducing material.

The skin allergy reducing material may be any one of gold, silver, enamel, titanium, nickel-free plating, and manicure.

Advantageous Effects

As described above, the ornament attachable and detachable apparatus according to the embodiment of the present invention may have the following effects.

According to the embodiment of the present invention, an ornament attachable and detachable apparatus for attaching and detaching an ornament to and from a product includes a first magnet, a second magnet, and a mounting portion and provides a technical configuration in which the first magnet is positioned on an inner surface of the product, a part of the second magnet is positioned on an outer surface of the product to correspond to the first magnet and has a different polarity from the first magnet, and the mounting portion mounts the ornament on the other portion of the second magnet, thereby attaching and detaching the ornament to and from the product without piercing the product through the first and second magnets. In particular, it is possible to attach and detach the ornament more effectively to products made of leather or silk which are difficult to be pierced by the clothes pins.

Further, the ornament can be attached and detached to and from the outer surface of the product by the first and second magnets interposed with the product, thereby safely and rapidly decorating the product of the user so as to respond to a fast fashion age in which a fashion is rapidly changed. In particular, since the ornament can be safely and rapidly attached and detached and the ornament can be easily moved, my own fashion product can be easily made with only my own ornament which is just one in the world, thereby reducing waste of resources and displaying my own personality.

Further, since a technical configuration using the first and second magnets is provided, the ornament attachable and detachable apparatus may exert a good influence on the human body like a health product using a magnet.

DESCRIPTION OF DRAWINGS

FIG. 1 is a cross-sectional view schematically illustrating an ornament attachable and detachable apparatus according to an embodiment of the present invention.

FIG. 2 is a cross-sectional view schematically illustrating an ornament attachable and detachable apparatus according to another embodiment of the present invention.

FIG. 3 is a cross-sectional view schematically illustrating an ornament attachable and detachable apparatus according to yet another embodiment of the present invention.

MODES OF THE INVENTION

Hereinafter, an embodiment of the present invention will be described more fully hereinafter with reference to the accompanying drawings so as to be easily implemented by those skilled in the art. However, the present invention may be implemented in various different forms and is not limited to an embodiment described herein.

FIG. 1 is a cross-sectional view schematically illustrating an ornament attachable and detachable apparatus according to an embodiment of the present invention.

An ornament attachable and detachable apparatus 100 according to an embodiment of the present invention as an ornament attachable and detachable apparatus for attaching and detaching an ornament 10 to a product 20 includes a first magnet 110, a second magnet 120, and a mounting portion 130 as illustrated in FIG. 1. Hereinafter, continuously referring to FIG. 1, each component will be described in detail.

The first magnet 110 is a component for attaching and detaching the ornament 10 to and from the product 20 together with the second magnet 120. The first magnet 110 may be positioned on an inner surface of the product 20 and may have any one polarity of an N pole and an S pole. Furthermore, as the first magnet 110, a strong magnet such as a neodymium magnet having a strong magnetism may be used.

Particularly, the first magnet 110 is not fixed to the inner surface of the product 20 by a separate fixing member (e.g., a thread or an adhesive), but has a structure in which the first magnet 110 may be moved to attach the ornament 10 to a location desired by a user in the product 20, thereby reducing the waste of resources and easily produce my own personality. For reference, when the location of the ornament 10 is determined, the ornament 10 may be fixed to the product 20 by magnetic force of the first and second magnets 110 and 120.

In addition, a surface of the first magnet 110 facing a human body may be coated with a skin allergy reducing material 140. For example, the skin allergy reducing material 140 may be any one of gold, silver, enamel, titanium, nickel-free plating, and manicure.

The second magnet 120 is a component for attaching and detaching the ornament 10 to and from the product 20 together with the first magnet 110. The second magnet 120 may be positioned on an outer surface of the product 20 to correspond to the first magnet 110 and may have one reaming one polarity of the N pole and the S pole. Furthermore, as the second magnet 120, the neodymium magnet having the strong magnetism such as the first magnet 110 described above may be used.

In particular, the ornament 10 may be attached to and detached from the outer surface of the product 20 in such a manner that the location of the second magnet 120 is fixed by the magnetic force with the product 20 interposed between the first magnet 110 and the second magnet 120. Accordingly, the product 20 of the user may be safely and rapidly decorated without going through a process such as piercing the product 20, etc. That is, attachment and detachment of the ornament 10 may be safely and rapidly facilitated unlike the related art.

The mounting portion 130 is a component for mounting the ornament 10 to another portion of the second magnet 120. The mounting portion 130 may include first and second Velcros 131 and 132. The first Velcro 131 may be a loop Velcro and fixed to another portion of the second magnet 120 by a first double-sided tape 131*a*. The second Velcro 132 may be a hook Velcro and may be fixed to the ornament by a second double-sided tape 132*a* and may be attached to and detached from the first Velcro 131 which is the loop Velcro. The hook Velcro and loop Velcro used for the first Velcro 131 and the second Velcro 132 may be reversed. For example, the second magnet is not directly fixed to the ornament 10 and the ornament 10 may be fixed to the second magnet 120 through the first and second Velcros 131 and 132.

Accordingly, when such a Velcro technique is used, an expensive neodymium magnet need not be used for each of all ornaments, and as a result, product cost of the ornament attachable and detachable apparatus 100 of the present invention may be reduced.

Accordingly, since the components are provided, the ornament 10 may be attached to and detached from the product 20 without piercing the product 20 through the first and second magnets 110 and 120. In particular, it is possible to attach and detach the ornament 10 more effectively to and from products 20 made of leather or silk which are difficult to be pierced by the clothes pins. Further, even though it is considered that durability of the product 20 is strengthened due to recent research and development of a fashion product material, the ornament 10 may be easily attached to and detached from even the product with the strengthened durability by using the ornament attachable and detachable apparatus 100 of the present invention. Moreover, the ornament 10 may be easily attached even to thick leather clothes, winter jackets, bags, and thick shoes, so that the ornament 10 may not be separated.

Further, the ornament 10 may be attached to and detached from the outer surface of the product 20 by the first and second magnets 110 and 120 interposed with the product 20, thereby safely and rapidly decorating the product 20 of the user so as to respond to a fast fashion age in which a fashion is rapidly changed. In particular, since the ornament 10 may be safely and rapidly attached and detached, my own fashion product may be easily made with only my own ornament 10 which is just one in the world, thereby reducing waste of resources and displaying my own personality. In other words, fashion trends for external designs and patterns are accelerated, and available products are also easily abandoned due to introduction of low-priced fast fashion products, which causes environmental pollution and waste of resources to make may own fashion product, thereby contributing to environmental protection even by recycling of resources. Furthermore, since it is possible to directly use the ornament 10 of a desired design according to the demand or personality of the individual, the satisfaction of the design of the fashion product may be enhanced. In addition, since one product 20 may be variously utilized by attaching and detaching the ornament 10 by using the ornament attachable and detachable apparatus 100 of the present invention, the waste may also be reduced by increasing a service life of the product.

Further, it is possible to attach and detach relatively wide ornaments (e.g., covers, handkerchiefs, Vinyl, etc.) to and from the product by using a plurality of ornament attachable and detachable apparatuses 100 of the present invention as well as relatively narrow ornaments (for example, accessories such as brooches).

Meanwhile, the product 20 in which the ornament attachable and detachable apparatus 100 according to an embodiment of the present invention is used may be any one of clothes, hats, shoes, and bags. Further, the material of the product 20 may include leather that is not easily pierced by the clothes pin, a silk material whose surface is weak, and the like.

Hereinafter, an ornament attachable and detachable apparatus 200 according to another embodiment of the present invention will be described with reference to FIG. 2.

FIG. 2 is a cross-sectional view schematically illustrating an ornament attachable and detachable apparatus according to another embodiment of the present invention.

An ornament attachable and detachable apparatus 200 according to another embodiment of the present invention is the same as an embodiment of the present invention except that the second Velcro (132 of FIG. 1) which is the hook Velcro and the ornament (10 of FIG. 1) are removed and the first Velcro (231 of FIG. 2) which is the loop Velcro replaces the ornament as illustrated in FIG. 2, and as a result, hereinafter, this will be primarily described.

The loop Velcro 231 may be used as the ornament 10 described above. In this case, the mounting portion 232 may be a double-sided tape that bonds the loop Velcro 231 to another portion of the second magnet 120. Thus, by varying a color or shape of the soft loop Velcro 231, it is possible to display may own design for the product 20.

Hereinafter, an ornament attachable and detachable apparatus 300 according to yet another embodiment of the present invention will be described with reference to FIG. 3.

FIG. 3 is a cross-sectional view schematically illustrating an ornament attachable and detachable apparatus according to yet another embodiment of the present invention.

An ornament attachable and detachable apparatus 300 according to yet another embodiment of the present invention is the same as an embodiment of the present invention described above except for a mounting portion 330, and as a result, hereinafter, this will be primarily described.

The mounting portion 330 may be a mounting groove 331 which is recessed in the ornament 10 and accommodates and mounts another portion of the second magnet 120. Furthermore, an adhesive agent 332 may be applied between an inner circumferential surface of the mounting groove 331 and another portion of the second magnet 120. Accordingly, since the second magnet 120 is directly inserted into the ornament 10 instead of the Velcro, a technical configuration may be simplified.

As described above, the ornament attachable and detachable apparatuses 100, 200, and 300 according to the embodiments of the present invention may have the following effects.

According to the embodiments of the present invention, the ornament 10 may be attached to and detached from the product 20 without piercing the product 20 through the first and second magnets 110 and 120. In particular, it is possible to attach and detach the ornament more effectively to products made of leather or thin silk which are difficult to be pierced by the clothes pins.

Further, the ornament 10 may be attached to and detached from the outer surface of the product 20 by the first and second magnets 110 and 120 interposed with the product 20, thereby safely and rapidly decorating the product 20 of the user so as to respond to a fast fashion age in which a fashion is rapidly changed. In particular, since the ornament 10 may be safely and rapidly attached and detached, my own fashion product may be easily made with only my own ornament 10 which is just one in the world, thereby reducing waste of resources and displaying my own personality.

Further, since a technical configuration using the first and second magnets 110 and 120 is provided, the ornament attachable and detachable apparatus may exert a good influence on the human body like a health product using a magnet.

While this invention has been described in connection with what is presently considered to be practical example embodiments, it is to be understood that the invention is not limited to the disclosed embodiments, but, on the contrary, is intended to cover various modifications and equivalent arrangements included within the spirit and scope of the appended claims.

SEQUENCE LIST TEXT

| | |
|---|---|
| 10: Ornament | 20: Product |
| 100, 200, 300: Ornament attachable and detachable apparatus | |
| 110: First magnet | 120: Second magnet |
| 130, 330: Mounting portion | 131: First Velcro |
| 131a: First double-sided tape | 132: Second Velcro |
| 132a: Second double-sided tape | 231: Loop Velcro |
| 232: Double-sided tape | 331: Mounting groove |
| 332: Adhesive agent | |

The invention claimed is:

1. An ornament attachable and detachable apparatus, consisting of:

a first single magnet positioned on an inner surface of a product, wherein a surface of the first single magnet facing an opposite side of the inner surface of the product is coated with a skin allergy reducing material;

a second single magnet of which a portion is positioned on an outer surface of the product to correspond to the first single magnet and which has a different polarity from the first single magnet; and an ornament having a mounting portion formed with a mounting groove which is recessed and allows the second single magnet to be inserted directly, wherein the mounting groove accommodates and mounts on another portion of the second single magnet, wherein the skin allergy reducing material is any one of gold, silver, enamel, titanium, and nickel-free plating.

* * * * *